US009962058B2

(12) United States Patent
Shin et al.

(10) Patent No.: US 9,962,058 B2
(45) Date of Patent: May 8, 2018

(54) DISHWASHER

(71) Applicant: LG ELECTRONICS INC., Seoul (KR)

(72) Inventors: Yongho Shin, Seoul (KR); Sanghoon Lee, Seoul (KR); Sangheon Yoon, Seoul (KR); Gapsu Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 38 days.

(21) Appl. No.: 14/685,279

(22) Filed: Apr. 13, 2015

(65) Prior Publication Data

US 2016/0007822 A1 Jan. 14, 2016

(30) Foreign Application Priority Data

Jul. 14, 2014 (KR) ..... 10-2014-0088286

(51) Int. Cl.
*A47L 15/22* (2006.01)
*A47L 15/23* (2006.01)
*A47L 15/42* (2006.01)

(52) U.S. Cl.
CPC ..... *A47L 15/22* (2013.01); *A47L 15/23* (2013.01); *A47L 15/4209* (2016.11)

(58) Field of Classification Search
CPC ..... A47L 15/14; A47L 15/16; A47L 15/18; A47L 15/22; A47L 15/23; A47L 15/4202; A47L 15/4204; A47L 15/4206; A47L 15/4208; A47L 15/4214; A47L 15/4219; A47L 15/4255; A47L 15/4278; A47L 15/428; A47L 2601/16
See application file for complete search history.

(56) References Cited

U.S. PATENT DOCUMENTS 3,312,232 A * 4/1967 Jenkins ..... A47L 15/23 134/176
5,333,631 A * 8/1994 Kirkland ..... A47L 15/4208 134/104.1
6,234,184 B1 * 5/2001 Tuller ..... A47L 15/4204 134/104.1
2004/0159339 A1 * 8/2004 Elick ..... A47L 15/4204 134/25.2
2005/0211278 A1 9/2005 Favaro et al.
(Continued)

FOREIGN PATENT DOCUMENTS

CN 1618392 A 5/2005
CN 103654669 A 3/2014
(Continued)

OTHER PUBLICATIONS

Machine Translation of Fukushima et al., JP 2005-319062A, Nov. 2005.*

*Primary Examiner* — David G Cormier
(74) *Attorney, Agent, or Firm* — Birch, Stewart, Kolasch & Birch, LLP

(57) ABSTRACT

A dishwasher includes a tub configured to define a washing space, a rack provided in the tub to provide a space where washing objects are held, a spray arm provided in the tub and located under the rack to spray wash water to the rack, and a noise shield provided between the spray arm and a bottom surface of the tub to reduce a kinetic energy of the wash water falling from above the spray arm toward the bottom surface of the tub.

10 Claims, 5 Drawing Sheets

(56) References Cited

U.S. PATENT DOCUMENTS

| | | | | |
|---|---|---|---|---|
| 2008/0135067 | A1* | 6/2008 | Mersch | A47L 15/4206<br>134/25.2 |
| 2011/0203619 | A1 | 8/2011 | Kara et al. | |
| 2012/0199169 | A1 | 8/2012 | Fritz et al. | |

FOREIGN PATENT DOCUMENTS

| | | | |
|---|---|---|---|
| DE | 23 57 084 | A1 | 5/1975 |
| EP | 1 415 585 | A1 | 5/2004 |
| EP | 1 941 827 | A1 | 7/2008 |
| EP | 2 486 838 | A2 | 8/2012 |
| JP | 2005-319062 | A | 11/2005 |
| JP | 2006-346077 | A | 12/2006 |
| JP | 2009-219917 | A | 10/2009 |

* cited by examiner

【Figure 1】
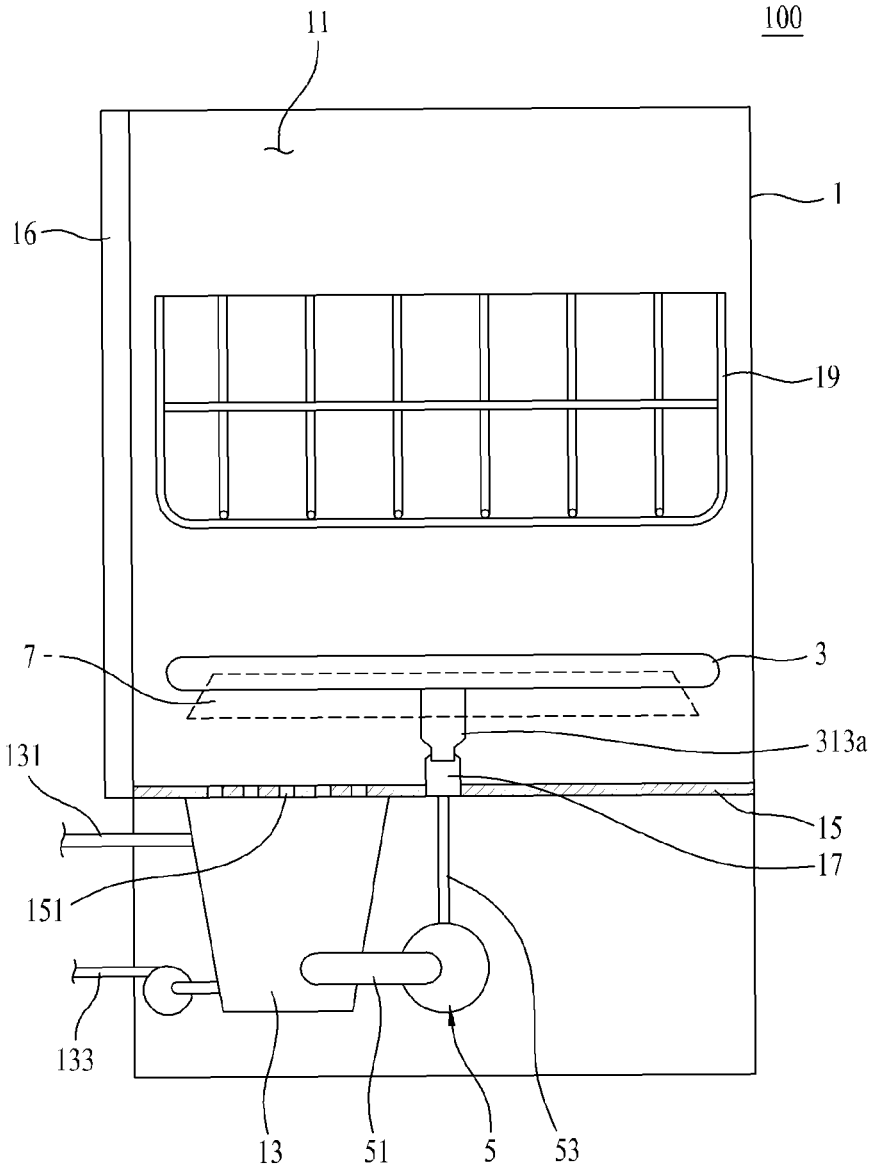

【Figure 2】
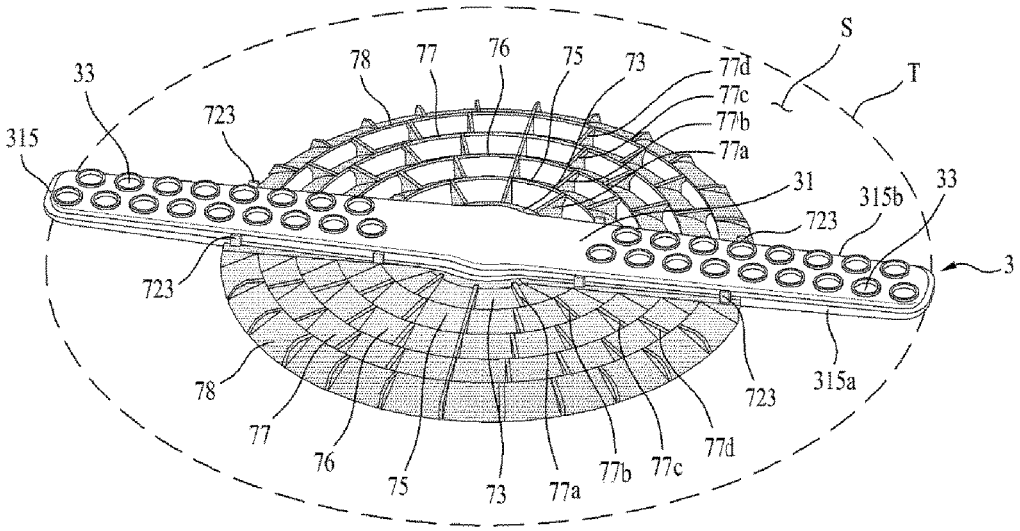

【Figure 3】
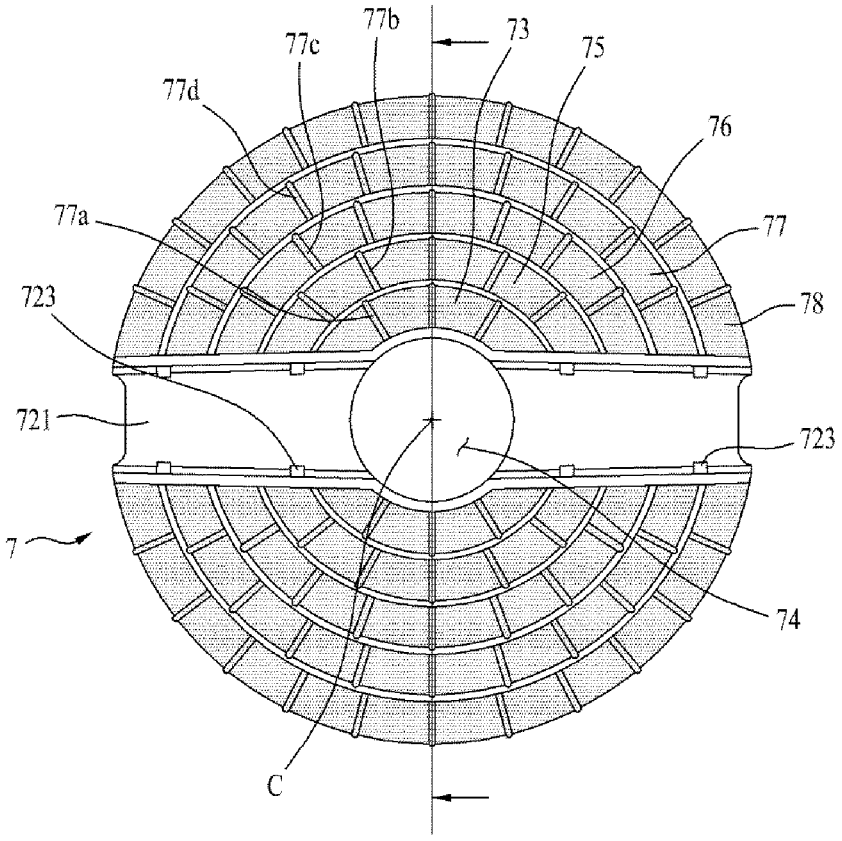
(a)
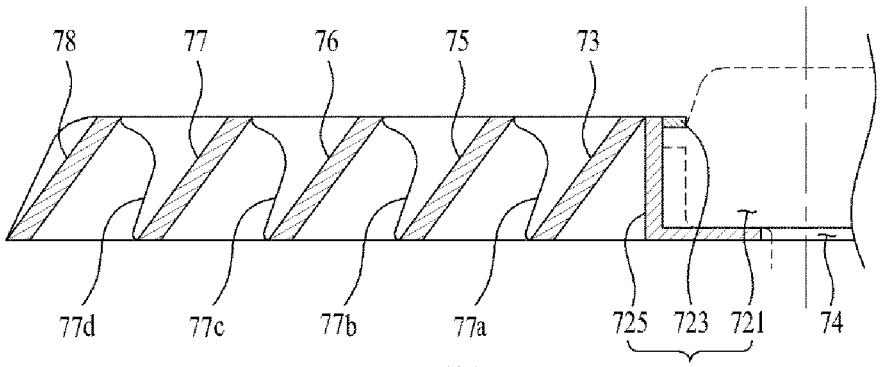
(b)

【Figure 4】
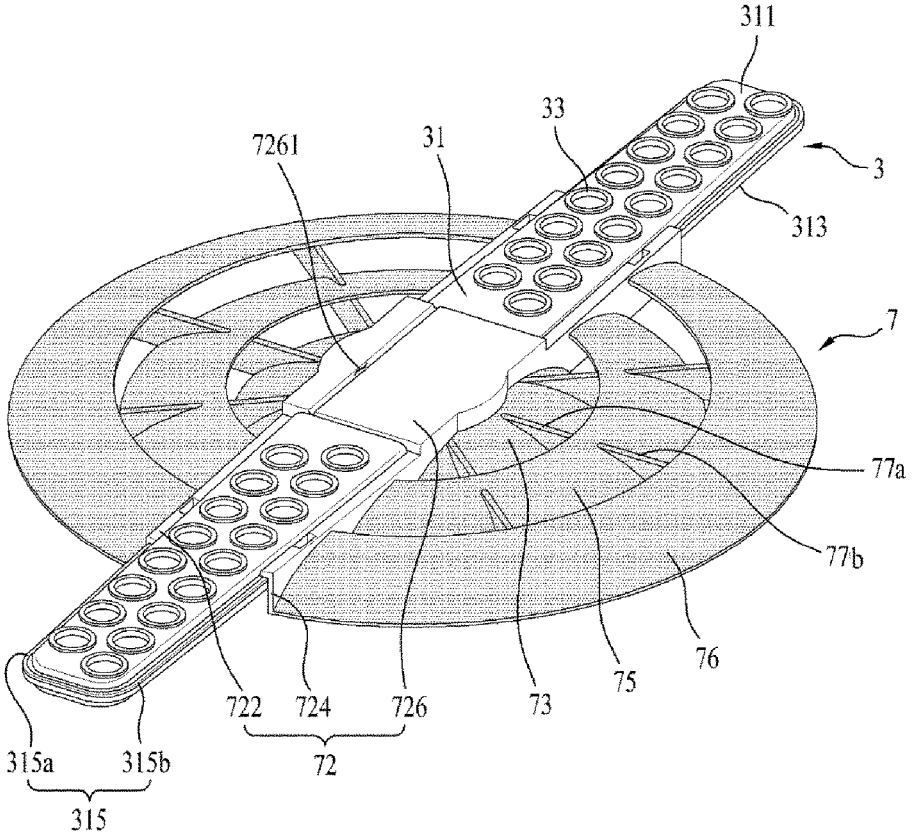

【Figure 5】
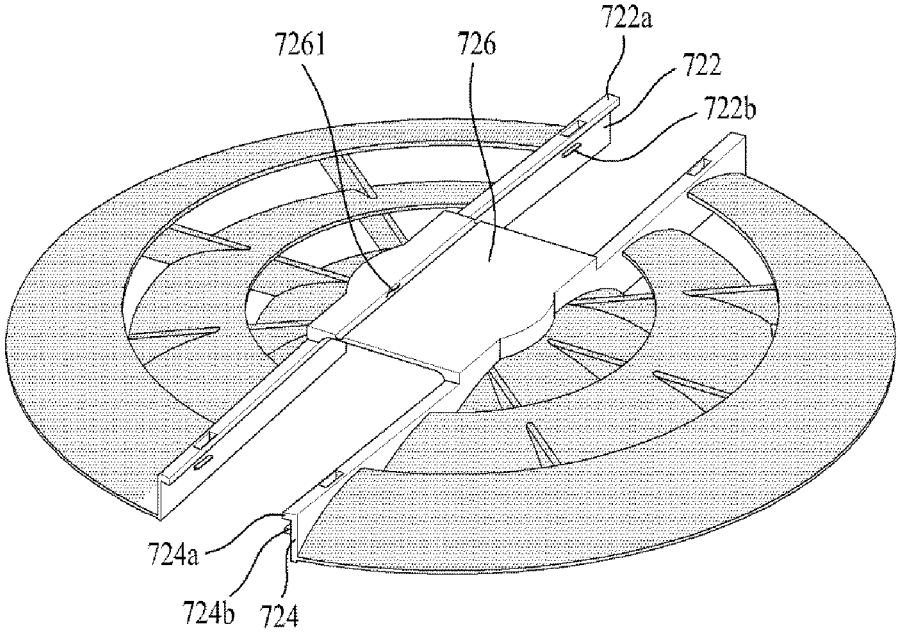

DISHWASHER

Pursuant to 35 U.S.C. § 119(a), this application claims the benefit of the earlier filing date and the right of priority to Korean Application No. 10-2014-0088286, filed on Jul. 14, 2014, the contents of which are hereby incorporated by reference herein in their entirety.

BACKGROUND OF THE DISCLOSURE

Field of the Disclosure

The present invention relates to a dishwasher.

Discussion of the Related Art

Dishwashers are electric home appliances configured to wash off scraps or dirt from dishes or utensils (hereinafter, washing objects), using dishwashing liquid and washing water.

A conventional dishwasher typically consists of a tub configured to provide a washing space, a rack provided to hold washing objects thereon, a spray arm configured to spray washing water to the rack, a sump in which washing water is stored, and a pump configured to supply the washing water stored in the sump to the spray arm.

From a user convenience perspective, noise or vibration has to be considered when designing a dishwasher.

The noise or vibration generated from the dishwasher is mainly caused by the pump. The vibration generated from the pump may be transmitted to the cabinet or the tub. The vibration generated from the pump could cause noise when transmitted to the cabinet or the tub.

Some of the noise or vibration in the dishwasher is generated while the wash water sprayed to the washing objects collides against the tub. Conventional dishwashers only include means configured to reduce the vibration or noise generated by the pump, but do not include means configured to reduce the noise or vibration generated while the washing water is collided against the tub.

SUMMARY OF THE DISCLOSURE

Exemplary embodiments of the present disclosure provide a dishwasher which can minimize noise or vibration.

Exemplary embodiments of the present disclosure also provide a dishwasher which can minimize the noise or vibration generated while the wash water sprayed into a tub collides against the tub.

To achieve these objects and other advantages and in accordance with the purpose of the invention, as embodied and broadly described herein, a dishwasher includes a tub configured to define a washing space; a rack provided in the tub to provide a space where washing objects are held; a spray arm provided in the tub to spray wash water to the rack, located under the rack; and a noise shield provided between the spray arm and a bottom surface of the tub to reduce a kinetic energy of the wash water falling from a top of the spray arm toward the bottom surface of the tub.

The noise shield may lower the drop velocity of the wash water falling from the top of the spray arm toward the bottom surface of the tub.

The spray arm may be rotatably provided in the tub, and the noise shield may be provided on a plane equal to a rotation surface formed by a rotation locus of the spray arm or under the rotation surface.

The noise shield may include a fixing unit fixed to the spray arm; a first plate fixed to the fixing unit, having a first diameter with respect to a rotational center of the spray arm; and a second plate spaced apart a preset distance from the first plate, having a second diameter larger than the first diameter with respect to the rotational center of the spray arm.

The noise shield may further include a spacer configured to keep the distance between the first plate and the second plate.

The first plate and the second plate may be inclined downwardly toward the bottom surface of the tub.

The fixing unit may include a fixing portion configured to fix the first plate and the second plate thereto; a bent portion provided in the fixing unit to accommodate an outer circumferential surface of the spray arm; and a coupling portion provided in the fixing body to prevent the spray arm from escaping from the bent portion.

The spray arm may include an arm flange projected from the outer circumferential surface of the spray arm, and the coupling portion may be detachable from the arm flange.

The fixing unit may include a first supporting portion and a second supporting portion configured to support both lateral surfaces of the spray arm, respectively, fixing the first plate and the second plate thereto.

The fixing unit may further include a bent groove provided in the connecting portion to rotate one or more of the first and second supporting portions in a direction getting far from the connecting portion.

The spray arm may further include a first arm flange provided in one lateral surface of the spray arm and a second arm flange provided in the other lateral surface of the spray arm, and the first supporting portion may include a first flange configured to support an upper surface of the first arm flange and a first projection configured to support a lower surface of the first arm flange, and the second supporting portion may include a second flange configured to support an upper surface of the second arm flange and a second projection configured to support a lower end of the second arm flange.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 1 is a diagram schematically illustrating a dishwasher in accordance with the present disclosure;

FIGS. 2 and 3 are diagrams illustrating one embodiment of a noise shield provided in the dishwasher in accordance with the present disclosure; and FIGS. 4 and 5 are diagrams illustrating another embodiment of the noise shield provided in the dishwasher in accordance with the present disclosure.

DESCRIPTION OF SPECIFIC EMBODIMENTS

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

FIG. 1 illustrates a structure of a dishwasher 100 in accordance with the present disclosure. The dishwasher 100 in accordance with the present disclosure may include a cabinet 1 configured to define an exterior appearance of the dishwasher 100, a tub 11 provided in the cabinet to define a washing space, a sump 13 providing a space in which washing water held in the tub is collected, and a door 16 coupled to the cabinet to open and close the washing space.

The tub 11 and the sump 13 are partitioned off by a cover 15 arranged on the sump 13. A collecting hole 151 is provided in the cover 15 to permit the wash water held in the tub 11 to flow to the sump 13.

A water supply path 131 is configured to supply the wash water to the cabinet 1, and a water drainage path 133 is configured to drain the wash water held in the sump 13 out of the cabinet 1.

A rack 19 may be provided in the tub 11 to hold the washing objects thereon. The rack 19 may be configured to retract from the tub 11 when the door 16 opens the tub 11. A rail (not shown) may be provided on an inner side of the tub 11 for guiding movement of the rack 19 into and out of the tub 11. A wheel or roller (not shown) may be further provided on the rack 19 for supporting the rack 19 on the rail.

A spray arm 3 is provided in the tub 11 to wash the washing objects held on the rack 19.

The spray arm 3 may be provided under the rack 19 to spray the wash water toward the rack 19. The spray arm 3 may be supplied with the wash water by a pump 5.

The pump 5 is supplied with the wash water from the sump 13 via an inlet path 51. The spray arm 3 is supplied with the wash water drawn into the pump 5 from the sump 13 via an outlet path 53.

An arm holder 17 may be further provided in the cover 15 to rotatably support the spray arm 3. In this instance, the outlet path 53 may connect the pump 5 and the arm holder 17 with each other.

Referring to FIG. 2, the structure of the spray arm 3 will be described hereinafter. The spray arm 3 may include an arm body 31 rotatably coupled to the arm holder 17 to be supplied with the wash water from the pump 5, and a spray hole 33 configured to spray the wash water drawn into the arm body 31 toward the rack 19.

An arm flange 315 may be projected from an outer circumferential surface of the arm body 31 or concavely curved from the outer circumferential surface of the arm body 31. The arm flange 315 may include a first arm flange 315*a* provided in one surface of the arm body 31 and a second arm flange 315*b* provided in the other opposite surface of the arm body 31.

The first arm flange 315*a* and the second arm flange 315*b* may be provided in both lateral surfaces of the arm body 31 which face each other, respectively.

When the arm body 31 includes an upper frame 311 (refer to FIG. 4) in which the spray hole 33 is provided, and a lower frame 313 (refer to FIG. 4) coupled to the upper frame 311, connectedly rotatable with respect to the arm holder 17, the arm flange 315 may be provided in the surface where the upper frame 311 and the lower frame 313 are coupled to each other.

The dishwasher having only the structure mentioned above could cause noise or vibration when the wash water sprayed from the spray arm 3 collides against an inner surface of the tub 11. Specifically, the wash water sprayed toward the rack 19 from the spray arm 3 provided under the rack 19 strikes the washing objects and the inner surface of the tub 11, and noise is thereby generated.

Of all the noise or vibration caused by the wash water exhausted from the spray arm 3, the noise or vibration generated while the wash water impacts against a bottom surface of the tub 11 or the cover 15 is the largest. In case some amount of wash water remains on the bottom surface of the tub 11 or the cover 15, the noise or vibration caused by the wash water is further increased.

To minimize the noise or vibration caused by the wash water falling in the tub 11, the dishwasher in accordance with the present disclosure may further include a noise shield 7.

The noise generated when the wash water falling in the tub 11 impacts against the bottom surface of the tub 11 or the cover 15 may be minimized by minimizing a kinetic energy of the wash water falling in the tub 11.

The noise shield 7 provided in the dishwasher in accordance with the present disclosure provides a means for minimizing a drop velocity, a mass and a drop height of wash water particles falling in the tub 11.

When the spray arm 3 is rotatably provided in the tub 11, the noise shield 7 is preferably provided on a plane equal to a rotation surface (S) formed by a rotation locus (T) of the spray arm 3 or under the rotation surface (S).

The noise shield 7 is provided on the plane or under the rotation surface (S) is to prevent a disadvantage of failing to supply the wash water sprayed from the spray arm 3 to the wash objects because of interference from the noise shield 7, and to lower the drop velocity of the wash water by colliding the wash water falling from an area above the spray arm 3 toward the bottom surface of the tub 11 against the noise shield 7.

When the noise shield 7 is provided on the plane equal to the rotation surface (S) or under the rotation surface (S), the size of the wash water particles after colliding against the noise shield 7 is reduced (i.e., the mass of the wash water particles is reduced) so that the noise or vibration generated when the wash water thereafter falls to the bottom surface of the tub 11 may be minimized.

When the noise shield 7 is provided on the plane equal to the rotation surface (S) or under the rotation surface (S) (e.g. between the spray arm and the bottom surface of the tub), a distance which is as far as the wash water particles having the kinetic energy reduced by the noise shield 7 fall toward the bottom surface of the tub 11 may be kept uniform so that the noise or vibration generated when the wash water is collided against the bottom surface of the tub 11 can be minimized.

The closer the noise shield 7 is provided to the bottom surface of the tub 11, the better so as to minimize the drop distance of the wash water particles having the kinetic energy reduced by the noise shield 7.

In order to realize the effects mentioned above, the noise shield 7 may include a fixing unit 72 coupled to the arm body 31, and one or more plates 73, 75, 76, 77 and 78 fixed to the fixing unit 72.

The fixing unit 72 may be provided in various shapes in order to be coupled to the arm body 31. As illustrated in FIG. 3, the fixing unit 72 may include a fixing body 725 provided along a longitudinal direction of the arm body 31, a bent portion 721 concavely bent from a surface of the fixing body 725, and a coupling portion 723 projected from the fixing body 725.

A hole 74 may be provided in the fixing body 725, and a connecting pipe 313*a* (refer to FIG. 1) connecting the arm holder 17 to the lower frame 313 may penetrate the hole 74. A center of the hole 74 may be arranged at a rotational center (C) of the spray arm.

If the lower frame 313 is directly connected to the arm holder 17 without the connecting pipe 313*a*, the arm holder 17 may be inserted in the hole 74 to be connected to the lower frame 313.

The bent portion 721 may be configured to accommodate an outer circumferential surface of the arm body 31, and the coupling portion 723 may be configured to prevent the arm body 31 from escaping from the bent portion 721.

As illustrated in FIG. 3, as one embodiment, the coupling portion 723 is provided to support an arm flange 315 provided in the arm body 31 so as to prevent the arm body 31 from escaping from the bent portion 721.

The plates provided in the noise shield 7 may include a first plate 73 having a first diameter with respect to the rotational center (C) of the spray arm; a second plate 75 having a second diameter larger than the first diameter, spaced apart a preset distance from the first plate 73; a third plate 76 having a third diameter larger than the second diameter, spaced apart a preset distance from the second plate 75; a fourth plate 77 having a fourth diameter larger than the third diameter, spaced apart a preset distance from the third plate 76; and a fifth plate 78 having a fifth diameter larger than the fourth diameter, spaced apart a preset distance from the fourth plate 77.

The first plate 73 may be formed in a hollow bar shape and fixed to the fixing body 725. The second through fifth plates 75, 76, 77 and 78 are fixed to the fixing body 725, formed in a hollow bar shape having a center equal to a center of the first plate.

In this instance, a distance between one plate and another plate is kept uniform by a spacer.

Specifically, the preset distance between the first plate 73 and the second plate 75 is maintained by a first spacer 77*a* so that the wash water dropped to the first plate 73 may fall to the bottom surface of the tub 11 via the space between the first plate 73 and the second plate 75.

Likewise, a distance between the second plate 75 and the third plate 76 is maintained by a second spacer 77*b*, a distance between the third plate 76 and the fourth plate 77 is maintained by a third spacer 77*c*, and a distance between the fourth plate 77 and the fifth plate 78 is maintained by a fourth spacer 77*d*.

When the distance between each two plates is kept uniform by each spacer, the time taken to collect the wash water in the sump may be reduced more than the time when the space for moving the wash water is not provided between each two places so that washing efficiency of the dishwasher may be prevented from deteriorating.

Furthermore, each of the plates 73, 75, 76, 77 and 78 may be inclined downwardly toward the bottom surface of the tub 11 with respect to the rotation surface (S) of the spray arm 3.

In other words, an upper end of the first plate 73 may be fixed to the fixing body 725, and a lower end of the first plate 73 may be spaced apart a preset distance from the fixing body 725. An upper end of the second plate 75 may be fixed to the first spacer 77*a*, and a lower end of the second plate 75 may be spaced apart a preset distance from the lower end of the first plate 73.

The plates are provided as described to guide the wash water falling against the noise shield 7 toward the bottom surface of the tub 11 and to minimize the area of the noise shield 7 formed by each of the plates.

The coupling relation between the third plate 76 and the fourth plate 77 and the coupling relation between the fourth plate 77 and the fifth plate 78 are equal to the coupling relation between the first plate 73 and the second plate 75, so that a detailed description of the coupling relations may be omitted.

FIG. 4 illustrates another embodiment of the noise shield 7 provided in the dishwasher in accordance with the present disclosure. The noise shield in accordance with this embodiment is similar to the noise shield shown in FIG. 3, except for the structure of the fixing unit 72.

In the structure disclosed by the embodiment of FIG. 3, the noise shield 7 has to be assembled together when the spray arm 3 is assembled. However, in the structure disclosed by the embodiment of FIG. 4, the noise shield 7 is attachable and detachable to and from the spray arm 3 by a user of the dishwasher 100.

For the detachable noise shield, the fixing unit 72 provided in the noise shield in accordance with the embodiment of FIG. 4 may include a first supporting portion 722 and a second supporting portion 724 provided at both lateral surfaces of the spray arm 3, respectively. The fixing unit 72 fixedly supports the plates 73, 75 and 76, and a connecting portion 726 disposed on an upper surface of the spray arm 3 that connects the first and second supporting portions 722 and 724 each other.

As illustrated in FIG. 5, the first supporting portion 722 includes a first flange 722*a* and a first projection 722*b*. The first flange 722*a* is configured to support an upper surface of a first arm flange 315*a* provided in the spray arm, and the first projection 722*b* is configured to support a lower surface of the first arm flange 315*a*.

The second supporting portion 724 includes a second flange 724*a* configured to support an upper surface of the second arm flange 315*b* provided in the spray arm, and a second projection 724*b* configured to support a lower end of the second arm flange 315*b*. Accordingly, the noise shield 7 in accordance with this embodiment may be detachable from the upper surface of the spray arm 3.

To facilitate the coupling between the noise shield 7 and the spray arm 3, the connecting portion 726 may further include a bent groove 7261 formed along a longitudinal direction of the spray arm 3.

When the bent groove 7261 is provided in the connecting portion 726, the bent groove 7261 acts as a hinge so that one or more of the first and second supporting portions 722 and 724 may be rotated in a direction away from the connecting portion 726 (i.e., a direction moving away from the surface of the spray arm) so that the coupling between the noise shield 7 and the spray arm 3 can be facilitated.

As illustrated, the noise shield 7 shown in FIGS. 4 and 5 has three plates 73, 75 and 76 as one example. However, the noise shield in accordance with this embodiment may include only one plate 73, two plates, or four or more plates.

As mentioned above, the embodiments of the present disclosure provide a dishwasher which can minimize noise and vibration.

The embodiments of the present disclosure also provide a dishwasher which can minimize the noise or vibration generated while the wash water sprayed in the tub is collided against the tub 11.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a tub providing a washing space;

a rack located inside the tub and configured to receive washing objects;

a spray arm rotatably provided in the tub, the spray arm being located under the rack and configured to spray wash water to the rack; and a noise shield provided above a bottom surface of the tub, the noise shield being configured to reduce a kinetic energy of the wash water falling from an area above the spray arm toward the bottom surface of the tub, wherein the noise shield comprises:

a plurality of half ring shaped plates having different diameters with respect to a rotational center of the spray arm, each of the plates being inclined downwardly towards the bottom surface of the tub to guide the wash water falling against the noise shield toward the bottom surface of the tub and lower the drop velocity of the wash water; and a spacer configured to maintain a preset distance between each of the plates, wherein the plurality of half ring shaped plates comprise:

a first plate having a first diameter with respect to the rotational center of the spray arm; and a second plate spaced apart a preset distance from the first plate, the second plate having a second diameter larger than the first diameter with respect to the rotational center of the spray arm, and wherein the first plate and the second plate are radially spaced apart from each other by the spacer so that the wash water is guided to the bottom surface of the tub through a space between the first plate and the second plate.

2. The dishwasher of claim 1, wherein the noise shield is provided on a plane coplanar to a rotation surface formed by a rotation locus of the spray arm.

3. The dishwasher of claim 1, wherein the noise shield is provided on a plane below a rotation surface formed by a rotation locus of the spray arm.

4. The dishwasher of claim 1, wherein the noise shield comprises a fixing unit fixed to the spray arm, and wherein the first plate is fixed to the fixing unit.

5. The dishwasher of claim 4, wherein the fixing unit comprises:

a fixing body configured to fix the first plate and the second plate thereto;

a bent portion configured to accommodate an outer surface of the spray arm therein; and a coupling portion configured to secure the spray arm in the bent portion.

6. The dishwasher of claim 5, wherein the spray arm comprises an arm flange projected from the outer surface of the spray arm, and wherein the coupling portion is detachably attached to the arm flange.

7. The dishwasher of claim 4, wherein the fixing unit comprises:

a first supporting portion configured to support a first lateral surface of the spray arm; and a second supporting portion configured to support a second lateral surface of the spray arm, wherein the first plate and the second plate are each fixed to the first supporting portion and the second supporting portion.

8. The dishwasher of claim 7, wherein the fixing unit further comprises a connecting portion interconnecting the first supporting portion and the second supporting portion, the connecting portion being located on an upper surface of the spray arm.

9. The dishwasher of claim 8, wherein the fixing unit further comprises a bent groove provided in the connecting portion, the bent groove permitting one or both of the first supporting portion and the second supporting portion to rotate in a direction away from the connecting portion to facilitate connection of the noise shield to the spray arm.

10. The dishwasher of claim 9, wherein the spray arm further comprises a first arm flange provided in a first lateral surface of the spray arm and a second arm flange provided in a second lateral surface of the spray arm, wherein the first supporting portion comprises:

a first flange configured to support an upper surface of the first arm flange; and a first projection configured to support a lower surface of the first arm flange, and wherein the second supporting portion comprises:

a second flange configured to support an upper surface of the second arm flange; and a second projection configured to support a lower end of the second arm flange.

* * * * *